US011930922B1

(12) United States Patent
Levine

(10) Patent No.: US 11,930,922 B1
(45) Date of Patent: Mar. 19, 2024

(54) EXPANDABLE STAND-ALONE SHELVING ASSEMBLY

(71) Applicant: Howard Levine, Belmar, NJ (US)

(72) Inventor: Howard Levine, Belmar, NJ (US)

( * ) Notice: Subject to any disclaimer, the term of this patent is extended or adjusted under 35 U.S.C. 154(b) by 0 days.

(21) Appl. No.: 18/504,691

(22) Filed: Nov. 8, 2023

(51) Int. Cl.

| | |
|---|---|
| ***A47B 47/04*** | (2006.01) |
| ***A47B 45/00*** | (2006.01) |
| ***A47B 57/54*** | (2006.01) |
| *A47B 57/06* | (2006.01) |
| *A47B 57/10* | (2006.01) |

(52) U.S. Cl.
CPC ..... *A47B 47/045* (2013.01); *A47B 45/00* (2013.01); *A47B 57/545* (2013.01); *A47B 57/06* (2013.01); *A47B 57/10* (2013.01)

(58) Field of Classification Search
CPC ..... A47B 47/045; A47B 57/545; A47B 45/00; A47B 96/025; A47B 57/06; A47B 47/00; A47B 47/0008; A47B 47/005; A47B 47/0083; A47B 57/08; A47B 57/10; A47B 57/32; A47B 57/34
See application file for complete search history.

(56) References Cited

U.S. PATENT DOCUMENTS

| | | | | | |
|---|---|---|---|---|---|
| D215,773 | S | * | 10/1969 | Maslow | D6/675.5 |
| 3,760,744 | A | * | 9/1973 | Cruckshank | A47B 45/00 108/102 |
| 4,155,312 | A | | 5/1979 | Thorkildson | |
| 4,267,931 | A | | 5/1981 | Belotta | |
| 4,428,304 | A | | 1/1984 | Moser | |
| 4,629,077 | A | * | 12/1986 | Niblock | A47B 57/265 211/187 |
| D326,579 | S | * | 6/1992 | Leeds | D6/705.6 |
| D341,967 | S | * | 12/1993 | Cohn | D6/705.7 |
| D413,218 | S | * | 8/1999 | Doty | D6/675.5 |
| 6,142,321 | A | * | 11/2000 | West | A47B 45/00 211/175 |
| 6,332,548 | B1 | | 12/2001 | West et al. | |
| D455,585 | S | * | 4/2002 | West | D6/705.7 |
| 6,622,876 | B2 | * | 9/2003 | Goldberg | A47F 5/01 108/147.11 |
| 7,188,740 | B2 | | 3/2007 | Marchetta et al. | |

(Continued)

FOREIGN PATENT DOCUMENTS

| | | | |
|---|---|---|---|
| CN | 213154740 | U | 5/2021 |
| CN | 217565302 | U | 10/2022 |

*Primary Examiner* — Devin K Barnett
(74) *Attorney, Agent, or Firm* — Carter, DeLuca & Farrell LLP; George Likourezos; Bret P. Shapiro

(57) ABSTRACT

An expandable stand-alone shelving assembly includes a post assembly and an expandable shelf. The post assembly includes an elongated post and a sleeve coupled to the elongated post. The expandable shelf includes an aperture, a first half, a second half, and an internal mechanism. The aperture accepts the sleeve of the post assembly. The first half of the expandable shelf includes a surface, a top end, and a bottom end. The second half of the expandable shelf includes an angled portion extending downwards from a surface of the second half. The internal mechanism includes a reinforcement bar connecting the top end and the bottom end of the first half, and a stop. The second half is slidably received within the first half. The stop of the internal mechanism engages with the angled portion of the second half to prevent the second half and first half from sliding apart.

20 Claims, 15 Drawing Sheets

(56) References Cited

U.S. PATENT DOCUMENTS

| | | | | |
|---|---|---|---|---|
| 7,246,711 | B1 * | 7/2007 | Metcalf | A47B 57/16 211/90.03 |
| 7,296,697 | B2 | 11/2007 | Costa et al. | |
| 7,611,111 | B2 | 11/2009 | Costa et al. | |
| 7,992,730 | B2 * | 8/2011 | Huang | A47B 57/265 211/187 |
| 8,256,630 | B2 * | 9/2012 | Zhu | A47B 31/04 211/195 |
| D690,966 | S * | 10/2013 | Goodman | D6/675.5 |
| 8,616,388 | B2 | 12/2013 | Butler | |
| 8,678,207 | B2 * | 3/2014 | Shimazaki | A47B 57/545 211/208 |
| D724,358 | S * | 3/2015 | Tsai | D6/675.3 |
| D730,666 | S * | 6/2015 | Goodman | D6/675.3 |
| D742,665 | S * | 11/2015 | Goodman | D6/675.5 |
| D766,024 | S * | 9/2016 | Brooks | D6/705.7 |
| D785,995 | S * | 5/2017 | Tsai | D6/705.6 |
| 10,077,934 | B1 * | 9/2018 | Dizon | F25D 25/005 |
| D936,401 | S * | 11/2021 | Wang | D6/675.5 |
| D974,089 | S * | 1/2023 | Sabounjian | D6/675.5 |
| D985,317 | S * | 5/2023 | Dart | D6/678 |
| 11,744,362 | B1 * | 9/2023 | Floarea | A47B 46/00 211/90.01 |
| 2009/0241812 | A1 * | 10/2009 | Liu | A47B 57/265 108/147.19 |
| 2013/0341296 | A1 * | 12/2013 | Sanford | F16B 12/40 211/187 |
| 2016/0198847 | A1 * | 7/2016 | Fu | A47B 47/0083 211/187 |
| 2021/0259438 | A1 * | 8/2021 | Oody | A47F 5/13 |

* cited by examiner

EXPANDABLE STAND-ALONE SHELVING ASSEMBLY

TECHNICAL FIELD

This disclosure relates generally to a shelf storage rack assembly, and more particularly to an expandable shelving storage rack assembly for use with an organization system in hospitals, hotels, restaurants, homes, and the like.

BACKGROUND

Shelf storage racks are used in a variety of settings, ranging from home use to use in hospitals and other facilities requiring organization systems. Sizing requirements for shelf storage racks may vary depending upon location and application, and changes in circumstance might require more shelving area than originally anticipated. Traditional shelf storage racks fail to provide variability in length, and longer shelf storage racks can be bulky and cumbersome to move.

Therefore, there exists a need for a stable, easily changeable shelving assembly capable of accommodating large spans.

SUMMARY

An aspect of this disclosure provides an expandable stand-alone shelving assembly including a post assembly including an elongated post and a sleeve, wherein the sleeve is configured to be coupled to the elongated post, and an expandable shelf including an aperture, a first half, a second half, and an internal mechanism. When the post assembly is inserted into the aperture, the aperture is configured to at least partially accept the sleeve of the post assembly such that the expandable shelf is supported by the post assembly. The first half of the expandable shelf includes a surface, a top end, and a bottom end. The second half of the expandable shelf includes a surface and an angled portion extending downwards from the surface of the second half. The internal mechanism includes a reinforcement bar connecting the top end and the bottom end of the first half, and a stop disposed on the reinforcement bar nonparallel to the reinforcement bar. The second half is slidably received within the first half such that the second half is partially surrounded by the first half and the internal mechanism. When the first half and the second half are slid apart a predetermined distance, the stop of the internal mechanism is configured to engage with the angled portion of the second half to prevent the second half and first half from sliding apart beyond the predetermined distance.

In another aspect of this disclosure, the elongated post includes an indentation.

In yet another aspect of this disclosure, an interior surface of the sleeve includes a protrusion configured to be at least partially inserted into the indentation of the elongated post.

In a further aspect of this disclosure, the sleeve includes a top end and a bottom end, and the bottom end of the sleeve is wider than the top end of the sleeve.

In another aspect of this disclosure, the top end of the first half and the bottom end of the first half of the expandable shelf each further includes a slide.

In yet another aspect of this disclosure, the reinforcement bar is disposed on the slide of the top end sidewall and the slide of the bottom end sidewall of the first half of the expandable shelf.

In a further aspect of this disclosure, the expandable stand-alone shelving assembly further includes a locking clip configured to connect the first half and the second half of the expandable shelf such that the first half and the second half of the expandable shelf are held in place relative to each other.

In another aspect of this disclosure, the surface of the first half and the surface of the second half of the expandable shelf are formed from metal wire.

In yet another aspect of this disclosure, the expandable stand-alone shelving assembly further includes a locking clip configured to latch onto a metal wire of the surface of the first half and a metal wire of the surface of the second half of the expandable shelf, and the locking clip is configured to hold the first half and the second half of the expandable shelf in place relative to each other.

In a further aspect of this disclosure, the stop is perpendicular to the reinforcement bar.

In another aspect of this disclosure, the expandable stand-alone shelving assembly further includes a plurality of expandable shelves.

An aspect of this disclosure provides an expandable stand-alone shelving assembly including a post assembly and an expandable shelf. The post assembly includes an elongated post and a sleeve. The elongated post includes a plurality of indentations spanning from a first end of the elongated post to a second end of the elongated post. The sleeve is configured to be coupled to the elongated post via an indentation of the plurality of indentations. The expandable shelf includes an aperture, a first half, a second half, and an internal mechanism. When the post assembly is inserted into the aperture, the aperture is configured to at least partially accept the sleeve of the post assembly such that the expandable shelf is supported by the post assembly. The first half of the expandable shelf includes a surface, a top end, and a bottom end, and a sidewall extending from each of the top end and the bottom end of the first half. The second half of the expandable shelf includes a surface and an angled portion extending downwards from the surface of the second half. The internal mechanism includes a slide disposed on each of the top end sidewall and the bottom end sidewall of the first half, a reinforcement bar connecting the top end sidewall and the bottom end sidewall of the first half, and a stop disposed on the reinforcement bar nonparallel to the reinforcement bar. The second half is slidably received within the first half such that the second half is partially surrounded by the first half and the internal mechanism. When the first half and the second half are slid apart a predetermined distance, the stop of the internal mechanism is configured to engage with the angled portion of the second half to prevent the second half and first half from sliding apart beyond the predetermined distance.

In another aspect of this disclosure, an interior surface of the sleeve includes a protrusion configured to be at least partially inserted into an indentation of the plurality of indentations of the elongated post.

In yet another aspect of this disclosure, the indentations of the elongated post are equally spaced apart.

In a further aspect of this disclosure, the sleeve includes a first half and a second half, wherein the first half of the sleeve is configured to partially couple to an indentation of the plurality of indentations of the elongated post and the second half of the sleeve is configured to partially couple to the indentation of the plurality of indentations of the elongated post.

In another aspect of this disclosure, the stop is parallel to the slides.

In yet another aspect of this disclosure, the surface of the first half of the expandable shelf and the surface of the second half of the expandable shelf are formed from metal wire.

In a further aspect of this disclosure the expandable stand-alone shelving assembly further includes a locking clip configured to latch onto a metal wire of the surface of the first half and a metal wire of the surface of the second half of the expandable shelf, wherein the locking clip is configured to hold the first half and the second half of the expandable shelf in place relative to each other.

An aspect of this disclosure provides an expandable stand-alone shelving assembly includes a post assembly, an expandable shelf, and a locking clip. The post assembly includes an elongated post and a sleeve. The elongated post includes a plurality of equally spaced annular indentations spanning from a first end of the elongated post to a second end of the elongated post. The sleeve includes a top end and a bottom end, wherein the bottom end of the sleeve is wider than the top end of the sleeve. The sleeve includes a first half and a second half configured to be coupled together. An interior surface of the sleeve includes an annular protrusion therearound, wherein the annular protrusion is configured to at least partially insert into an annular indentation of the plurality of annular indentations of the elongated post. The expandable shelf includes an aperture, a first half, a second half, and an internal mechanism. When the post assembly is inserted into the aperture, the aperture is configured to partially accept the sleeve of the post assembly such that the expandable shelf is supported by the post assembly. The first half of the expandable shelf includes a surface, a first end, a second end, a top end, a bottom end, a sidewall extending around the surface of the first half at the first end, the top end, and the bottom end of the first half. The second half of the expandable shelf includes a surface, a first end, a second end, a top end, a bottom end, a sidewall extending around the surface of the second half at the second end, the top end, and the bottom end of the second half, and an angled portion extending downwards from the surface of the second half at the first end of the second half. The internal mechanism includes a slide disposed on each of the top end sidewall and the bottom end sidewall of the first half, reinforcement bars connecting the slides, and a stop disposed across the reinforcement bars. The second half is slidably received within the first half such that the second half is partially enclosed by the first half and the internal mechanism. When the first half and the second half are slid apart a predetermined distance, the stop of the internal mechanism is configured to engage with the angled portion of the second half to prevent the second half and first half from sliding apart beyond the predetermined distance. The locking clip is configured to connect the first half and the second half of the expandable shelf such that the first half and the second half of the expandable shelf are held in place relative to each other.

In another aspect of this disclosure, the surface of the first half of the expandable shelf and the surface of the second half of the expandable shelf are formed from metal wire, and the locking clip is configured to latch onto a metal wire of the surface of the first half and a metal wire of the surface of the second half of the expandable shelf.

Further details and aspects of the present disclosure are described in more detail below with reference to the appended drawings.

BRIEF DESCRIPTION OF DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
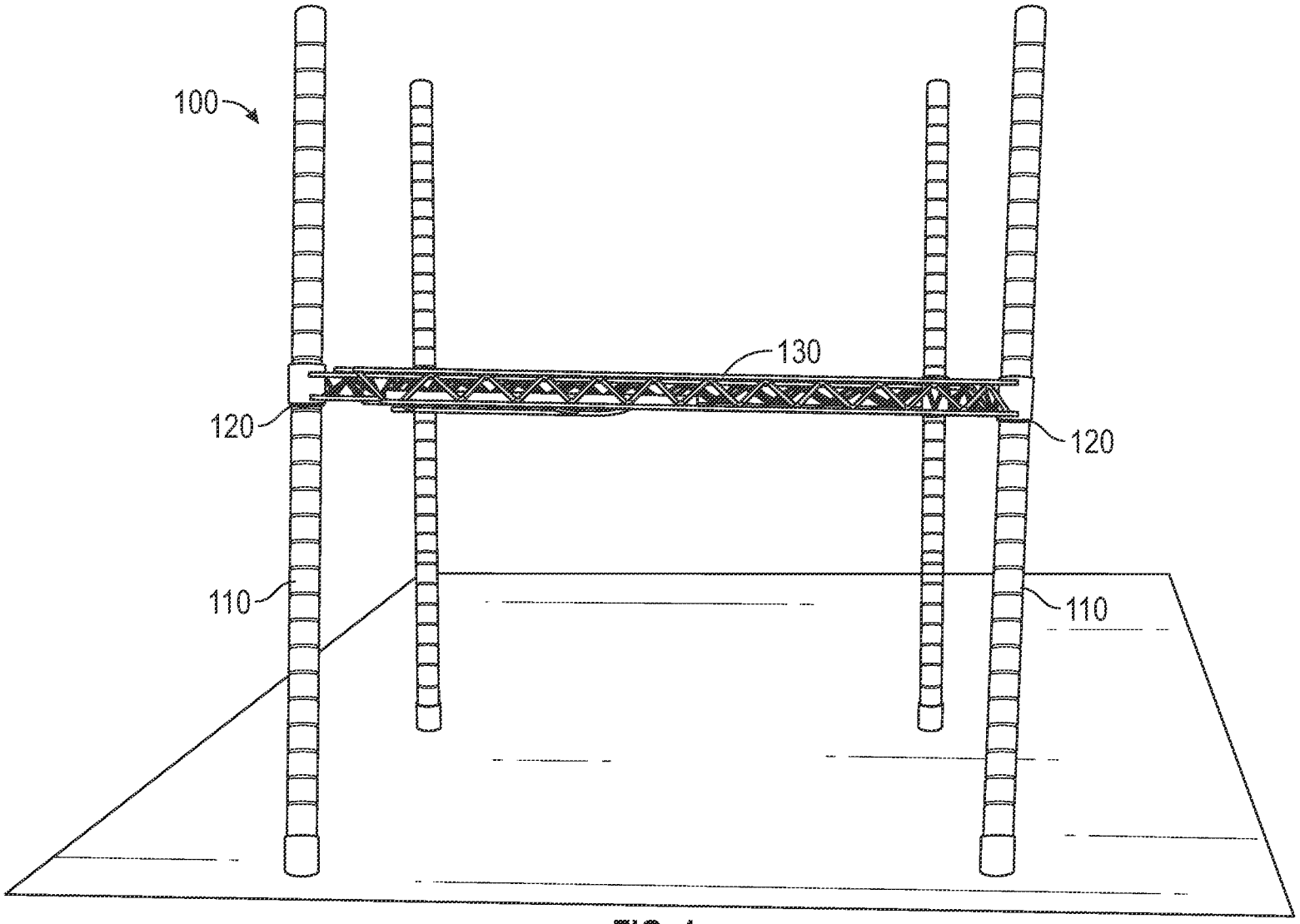
FIG. 1 illustrates an exemplary expandable stand-alone shelving assembly utilizing an expandable shelf connected to elongated posts, in accordance with aspects of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Referring to FIG. 1, an expandable stand-alone shelving assembly 100 in accordance with at least some embodiments described herein is shown. Expandable stand-alone shelving assembly 100 generally includes one or more post assemblies 110, including one or more sleeves 120 disposed thereon, wherein the post assemblies 100 are configured to support one or more expandable shelves 130. Although the configuration of FIG. 1 shows only one expandable shelf 130, it is contemplated that multiple expandable shelves 130 may be supported by post assemblies 110.

Figure 2A:
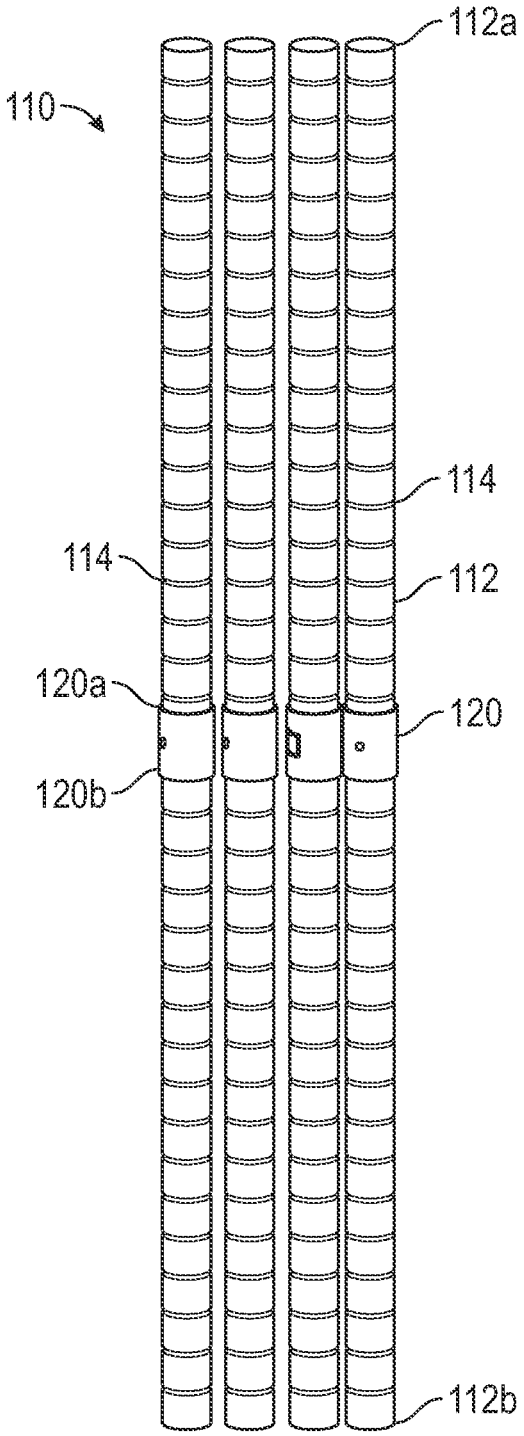
FIG. 2A illustrates a front view of an elongated post configured to receive a sleeve, in accordance with aspects of the present disclosure.

FIG. 2A shows post assembly 110, including sleeve 120, as previously noted. Post assembly 110 additionally includes elongated post 112, having a top end 112*a* and a bottom end 112*b*. Bottom end 112*b* of elongated post 112 may be seated on a surface (e.g., a ground surface) to support expandable stand-alone shelving assembly 100 when fully assembled. Elongated post 112 may be formed from a metal, for example, a steel or stainless steel, to increase durability and sanitation. Elongated post 112 may be chrome plated or powder coated. Elongated post 112 may include one or more indentations 114 to allow expandable shelf 130 to be height-adjustable. Indentation 114 may be annular, as shown, or may be any other suitable shape. For example, indentation 114 may be a circular or square notch formed in elongated post 112. Indentations 114 may span from bottom end 112*b* to top end 112*a* of elongated post 112 and in aspects, indentations 114 may be spaced apart at equal increments. An internal surface 128 of sleeve 120 includes a protrusion 122 (shown in FIG. 2B) which interfaces with indentation 114 of elongated post 112. Sleeve 120 is therefore held in place at a point of contact with indentation 114. Sleeve 120 may be primarily cylindrical or may be any other suitable shape. Sleeve 120 includes a top end 120*a* and a bottom end 120*b*. A diameter of top end 120*a* may be smaller than a diameter of bottom end 120*b*, that is, sleeve 120 may be wider at bottom end 120*b* than top end 120*a*, to provide increased support for expandable shelf 130.

Figure 2B:
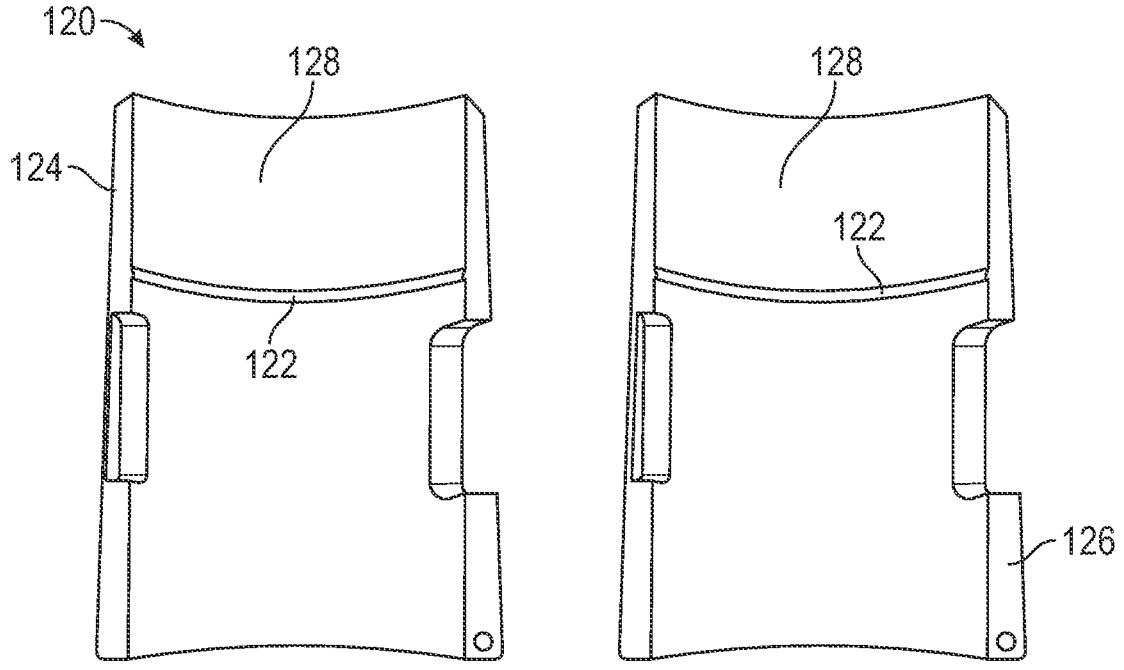
FIG. 2B illustrates an internal view of the sleeve configured to be connected to the elongated post of FIG. 2A.

A detailed view of sleeve 120 is shown in FIG. 2B. Protrusion 122 is configured to contour indentation 114 of elongated post 112 such that protrusion 122 is at least partially inserted into indentation 114. FIG. 2B shows indentations 114 of elongated post 112 as being annular, therefore protrusion 122 of sleeve 120 may be annular as well. Protrusion 122 may also be shaped in any way suitable for protrusion 122 to mate with indentation 114. In aspects, sleeve 120 may include a first half 124 and a second half 126. To assemble sleeve 120 from first half 124 and second half 126, protrusion 122 of first half 124 of sleeve 120 may be aligned with a first indentation 114 of elongated post 112. Protrusion 122 of second half 126 of sleeve 120 may then also be aligned with the first indentation 114 of elongated post 112. First half 124 and second half 126 may then be coupled together, for example, by press fit, snap fit, mechanical fastening, or any other suitable means.

Figure 3:
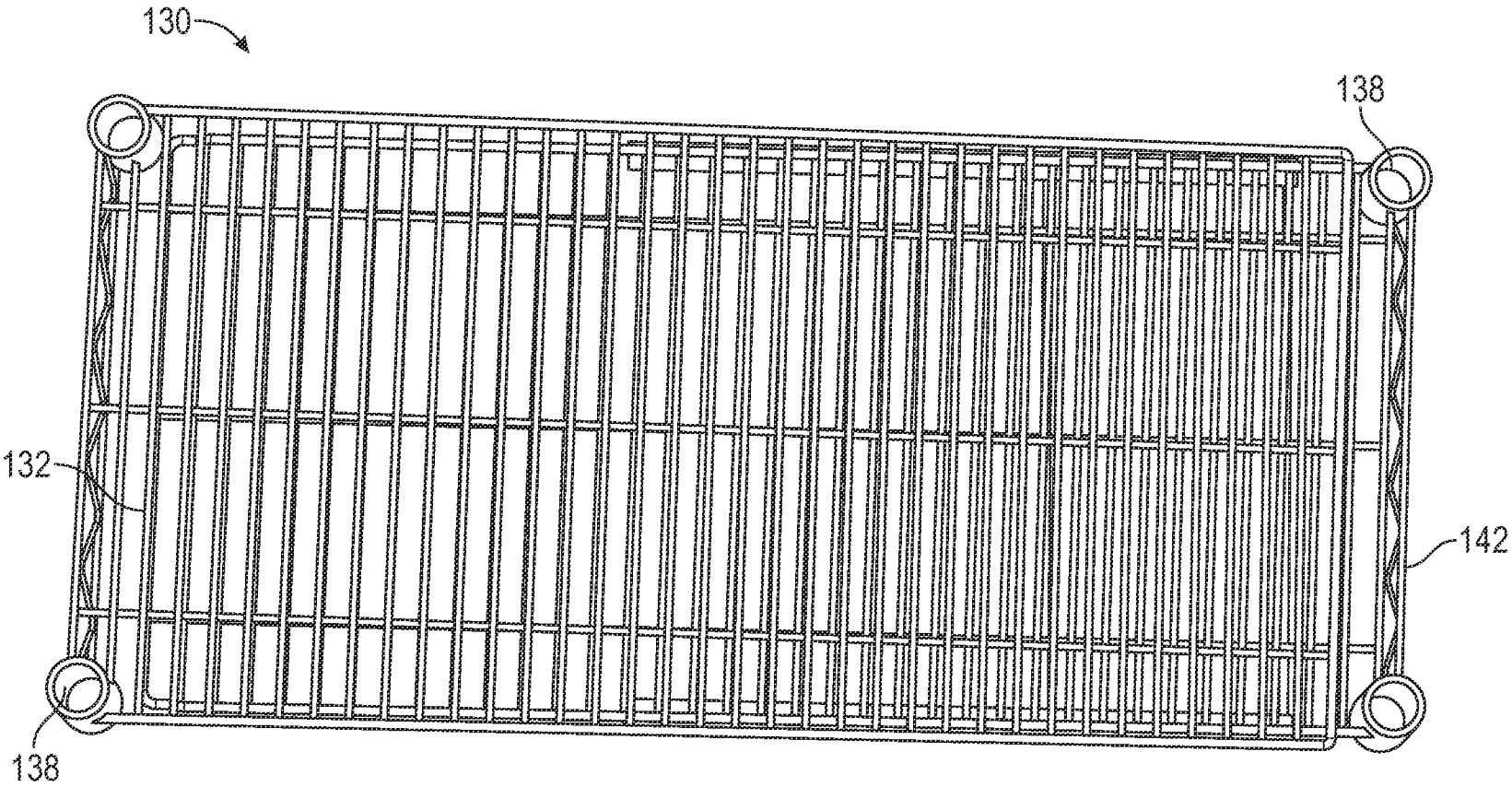
FIG. 3 illustrates a top view of the expandable shelf in a closed position, in accordance with aspects of the present disclosure.

FIG. 3 is a top-side view of expandable shelf 130 in a closed position. Expandable shelf 130 may be fabricated from a metal, such as a steel or stainless steel, to provide high strength and durability. Expandable shelf 130 may be formed from metal wire, for example, cold rolled steel wire. Expandable shelf 130 may also be chrome plated or powder coated. Expandable shelf 130 includes a first half 132 and a second half 142. First half 132 may include a first end 132*a*, a second end 132*b*, a top end 132*c*, and a bottom end 132*d* (shown in FIG. 6), as well as a surface 134. Surface 134 may include a top side and an underside. The underside of surface 134 may be bounded by a side wall 136 at first end 132*a*, top end 132*c*, and bottom end 132*d*, leaving first half 132 open at second end 132*b*. Second half 142 may include a first end 142*a*, a second end 142*b*, a top end 142*c*, and a bottom end 142*d* (shown in FIG. 6), as well as a surface 144. Surface 144 may include a top side and an underside. The underside of surface 144 may be bounded by a side wall 146 at second end 142*b*, top end 142*c*, and bottom end 142*d*, leaving second half 142 open at first end 142*a*. Second half 142 may be sized to fit within side wall 136 of first half 132. Beginning from first end 142*a*, second half 142 may be inserted into first half 132 at second end 132*b* such that the underside of surface 134 and the top side of surface 144 are in contact with each other. Thus, when expandable shelf 130 is in the closed position, a majority of second half 142 is received within first half 132.

Expandable shelf 130 additionally includes one or more apertures 138. Each aperture 138 is sized such that at least a portion of sleeve 120 fits therewithin when sleeve 120 is attached to elongated post 112. To assemble expandable stand-alone shelf 100, expandable shelf 130 may be vertically lowered onto post assemblies 110 such that apertures 138 at least partially capture each sleeve 120 of post assemblies 110. For example, when the diameter of top end 120*a* is smaller than the diameter of bottom end 120*b*, a substantial portion of sleeve 120 may insert into aperture 138, while bottom end 120*b* may remain below aperture 138. Expandable shelf 130 may therefore be supported at a specific height by sleeves 120, and may be partially seated on sleeves 120. Apertures 138 may be disposed through each of first half 132 and second half 142. In aspects, apertures 138 may be disposed at corner portions of first half 132 and second half 142. For example, a first aperture 138 may be disposed through the side wall 136 of first half 132 where first end 132*a* and top end 132*c* meet. A second aperture 138 may be disposed through the side wall 136 of first half 132 where first end 132*a* and bottom end 132*d* meet. A third aperture 138 may be disposed through the side wall 146 of second half 142 where second end 142*b* and top end 142*c* meet. A fourth aperture may be disposed through the side wall 146 of second half 142 where second end 142*b* and bottom end 142*d* meet. Although apertures 138 are shown in four corners of expandable shelf 130, other aperture 138 configurations are contemplated as well. In aspects, expandable shelf 130 may be mounted to one or more wall brackets (not shown) in addition to, or instead of, post assembly 110.

Figure 4:
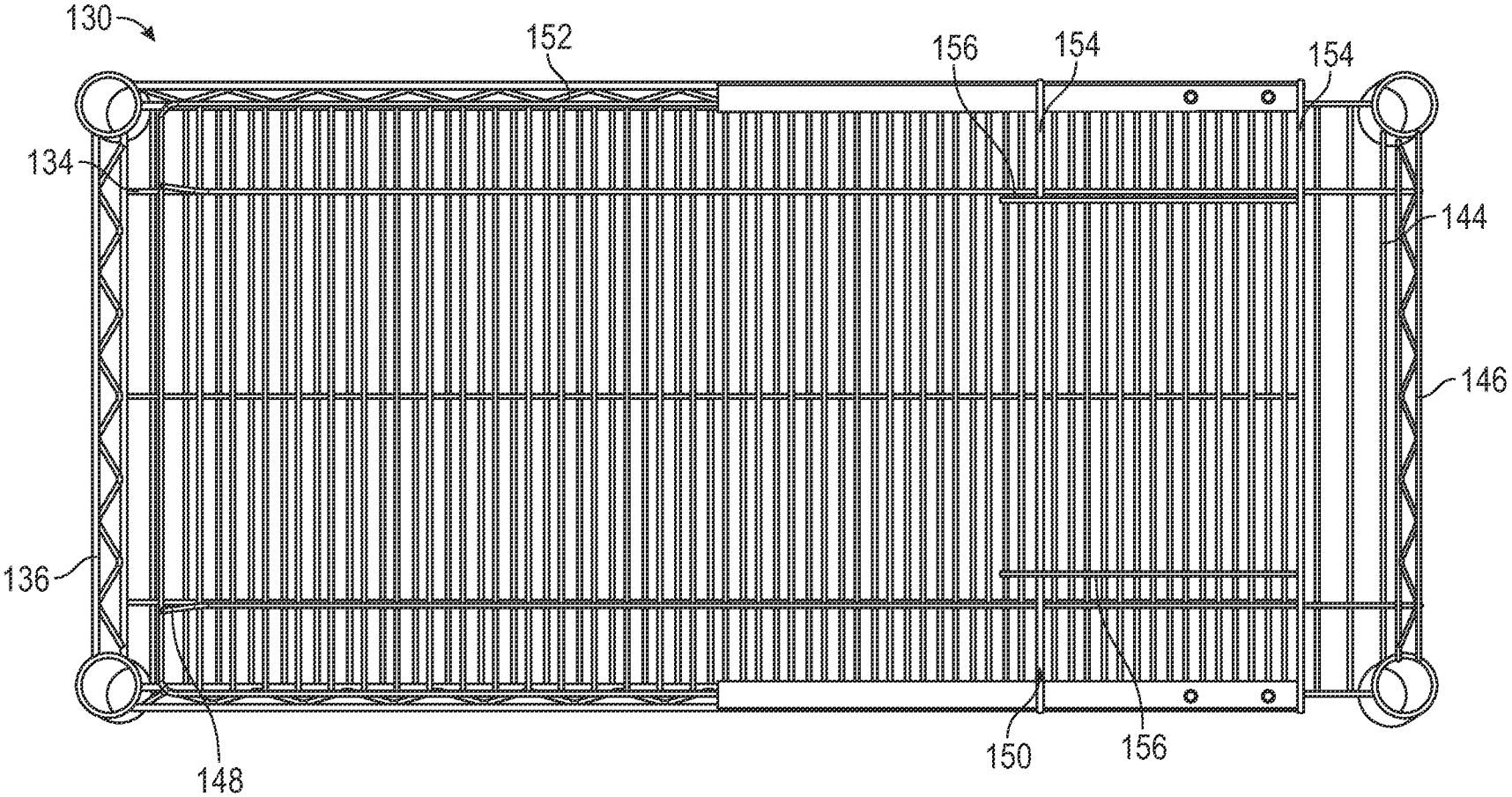
FIG. 4 illustrates a bottom view of the expandable shelf in a closed position, in accordance with aspects of the present disclosure.

FIG. 4 shows an underside view of expandable shelf 130 in the closed position. When expandable shelf 130 is in the closed position, second half 142 may be received within first half 132 such that first end 142*a* of second half 142 is in close proximity to first end 132*a* of first half 132. Surface 144 of second half 142 may include an angled portion 148 disposed at first end 142*a*. While the figures show angled portion 148 extending downward from surface 144 at approximately a thirty-degree angle, it is contemplated that angled portion 148 may extend downward from surface 144 at any angle.

Expandable shelf 130 may further include an internal mechanism 150 (e.g., internal sliding and locking mechanism) to facilitate first half 132 and second half 142 sliding relative to each other. Internal mechanism 150 may be installed on first half 132. Internal mechanism 150 includes one or more slides 152, one or more reinforcement bars 154, and one or more stops 156. Slides 152 may be formed from sheet metal, for example, a steel or a stainless steel. Slides 152 may also be chrome plated or powder coated. Slides 152 may each have a right-angle cross section. In aspects, slides 152 may be disposed on side wall 136 of first half 132, and may be connected by spot welding, adhesive, mechanical fastening, or any other suitable means. For example, a first slide 152 may be disposed on side wall 136 located on top end 132*c* of first half 132, and a second slide 152 may be disposed on side wall 136 located on bottom end 132*d* of first half 132. Thus, the first slide 152 and the second slide 152 may be parallel. Slides 152 are configured to aid second half 142 in gliding away from first half 132 when expandable shelf 130 is moved from the closed position to a partially expanded or fully expanded position.

The first slide 152 and the second slide 152 may be connected by reinforcement bars 154, such that when second half 142 is received within first half 132, reinforcement bars 154 at least partially enclose second half 142, holding first half 132 and second half 142 together and providing support to expandable shelf 130. Reinforcement bars 154 may be arranged perpendicularly to the first slide 152 and the second slide 152. Reinforcement bars 154 may be connected to slides 152 by spot welding, adhesive, mechanical fastening, or any other suitable means. Stops 156 may be connected across reinforcement bars 154 by spot welding, adhesive, mechanical fastening, or any other suitable means. Stops 156 may be parallel to slides 152 or nonparallel to reinforcement bars 154. In other aspects, stops 156 may instead be installed across reinforcement bars 154 at any angle. Stops 156 are oriented such that an end of each stop 156 faces angled portion 148 of second half 142. Stops 156 are configured to engage with angled portion 148 of second half 142 to prevent first half 132 and second half 142 from moving apart relative to each other when expandable shelf 130 is in a fully expanded position. Stops 156 will be explained in further detail in the paragraphs making reference to FIGS. 7, 8A, and 8B.

Figure 5:
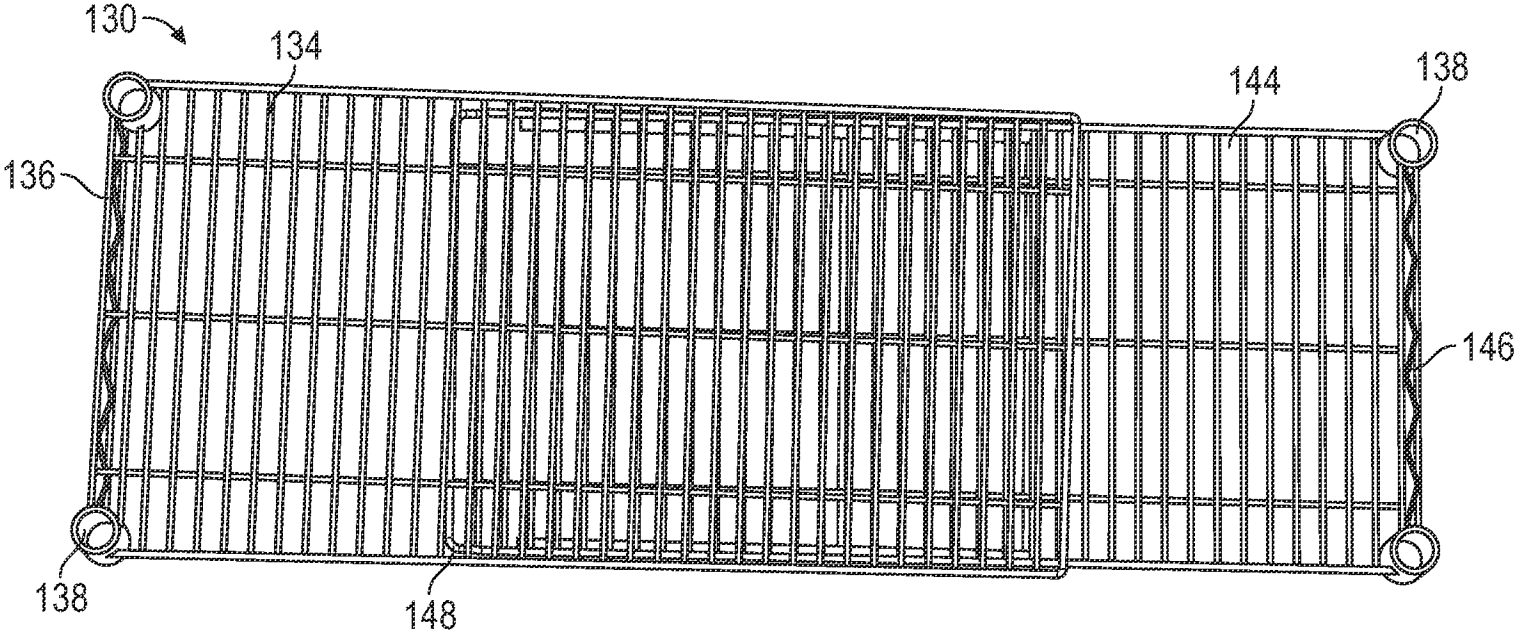
FIG. 5 illustrates a top view of the expandable metal shelf in an approximately halfway expanded position, in accordance with aspects of the present disclosure.
Figure 6:
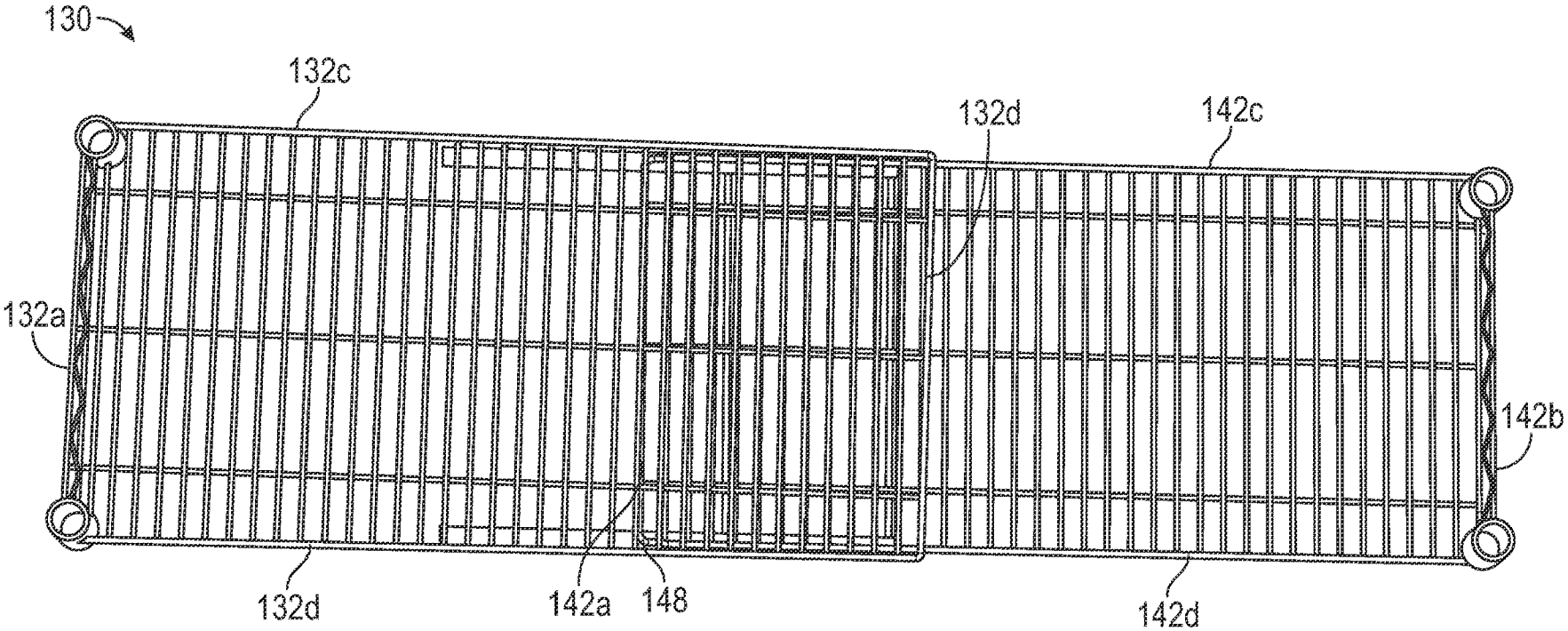
FIG. 6 illustrates a top view of the expandable shelf in a fully expanded position, in accordance with aspects of the present disclosure.

Referring to FIG. 5, a top-down view of expandable shelf 130 is shown, with expandable shelf 130 partially expanded into approximately a halfway expanded position. Referring to FIG. 6, expandable shelf 130 is shown in the fully expanded position. In the fully expanded position, first half 132 and second half 142 are moved apart a predetermined distance until stops 156 of internal mechanism 150 of first half 132 come into contact with angled portion 148 of second half 142. First half 132 and second half 142 are then prevented from being moved further apart. The predetermined distance is dependent on a closed length and a fully expanded length of expandable shelf 130. For example, if the closed length of expandable shelf 130 is thirty inches and the fully expanded length of expandable shelf 130 is forty-eight inches, the predetermined distance that first half 132 and second half 142 could be slid away from each other would be eighteen inches. Once first half 132 and second half 142 were moved apart eighteen inches, the stops 156 of internal mechanism 150 would engage with angled portion 148 of second half 142, preventing expandable shelf 130 from extending further.

It is contemplated that expandable shelf 130 may be configured to expand to a variety of additional sizes. In aspects, a length of expandable shelf 130 may be adjustable from twelve inches to eighteen inches, from eighteen inches to thirty inches, from twenty-four inches to forty inches, from thirty-four inches to sixty inches, from forty-two inches to seventy-two inches, from forty-eight to eighty-four inches, from sixty inches to ninety-six inches, or from seventy-two inches to one hundred twenty inches. Additional ranges of length are contemplated as well. Furthermore, expandable shelf 130 may be supplied in different widths. For example, expandable shelf 130 may have a width of twelve inches, fourteen inches, eighteen inches, twenty inches, twenty-two inches, twenty-four inches, or thirty inches, with additional widths being contemplated.

Figure 7:
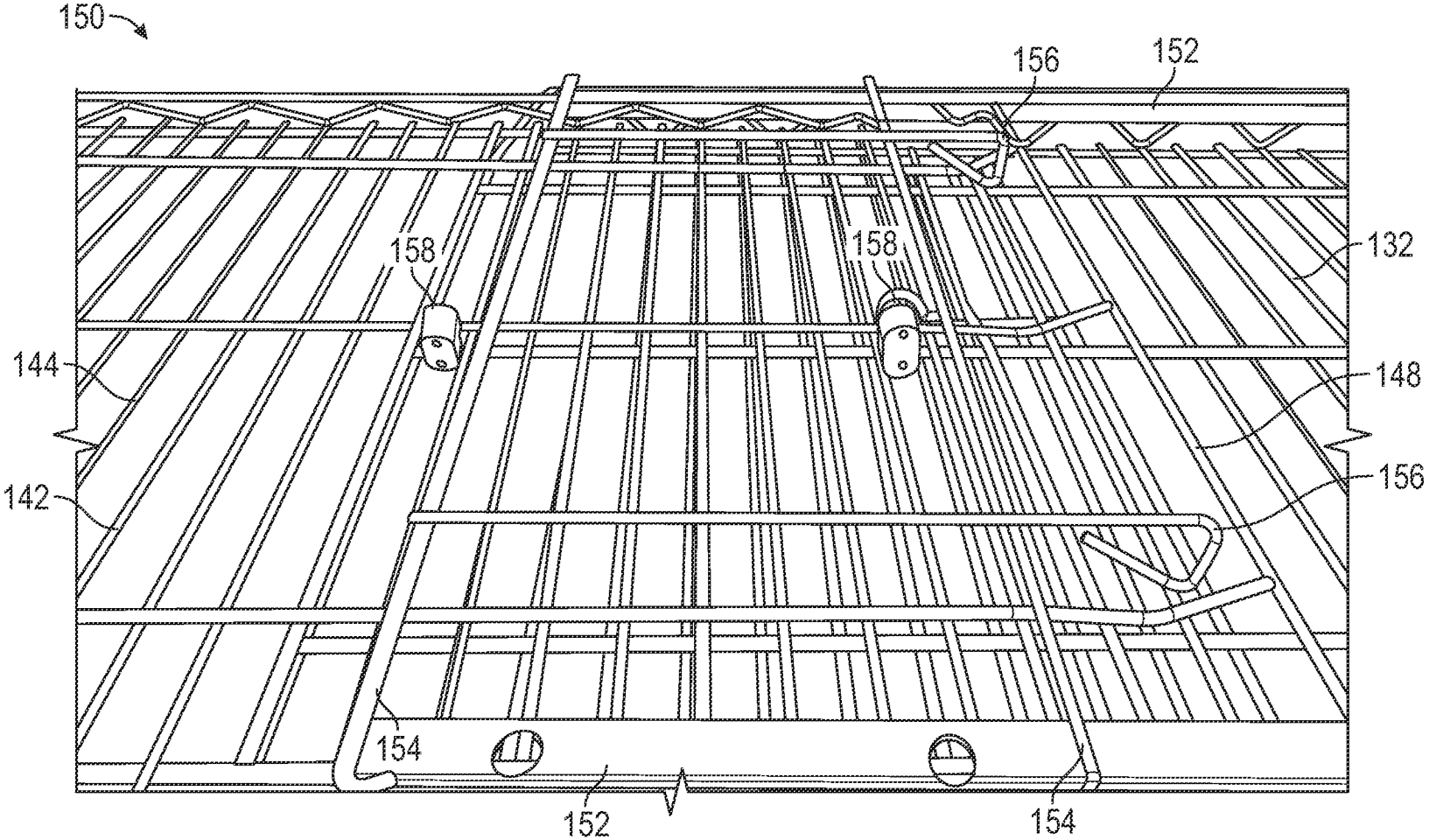
FIG. 7 illustrates a perspective view of the internal sliding and locking mechanism of the expandable metal shelf of FIGS. 4 and 5.
Figure 8A:
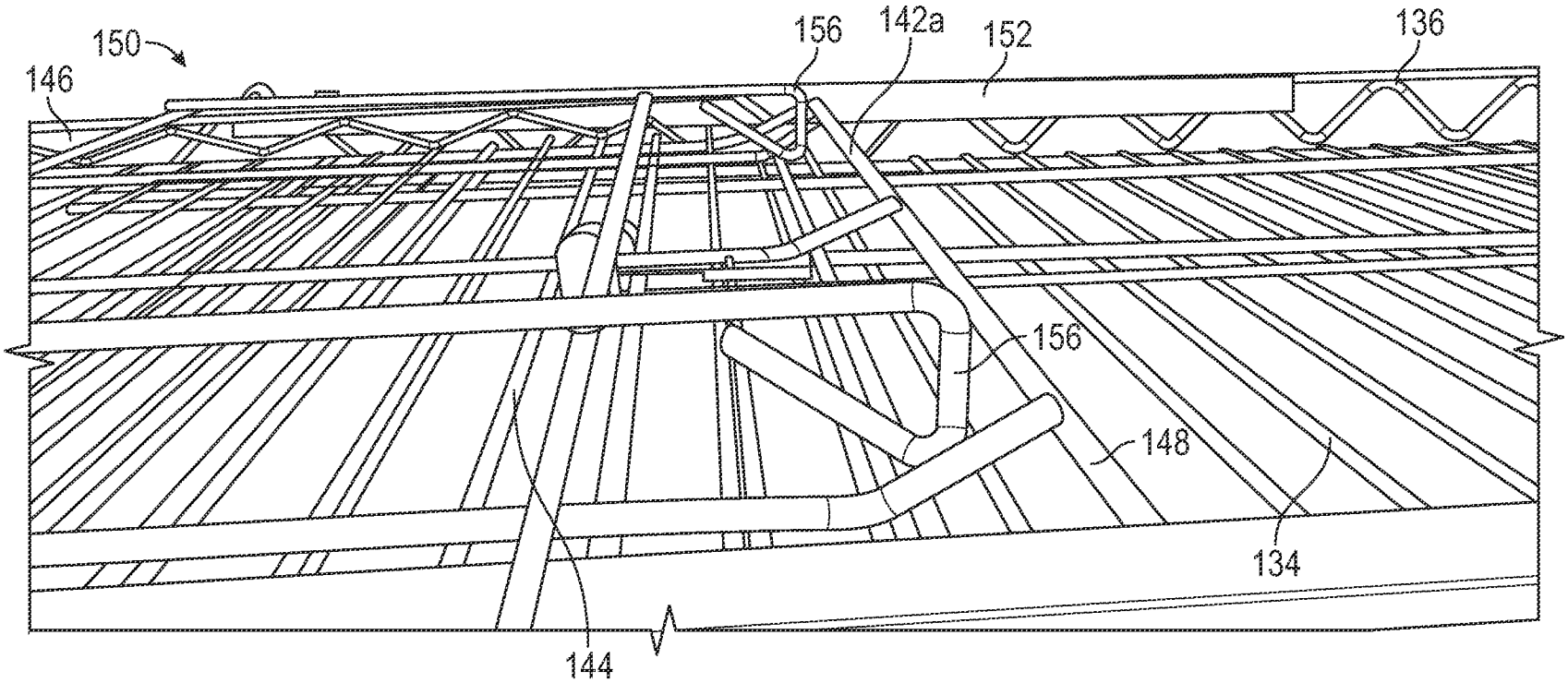
FIG. 8A illustrates a perspective side view of built in stops of the internal locking mechanism of FIG. 7.
Figure 8B:
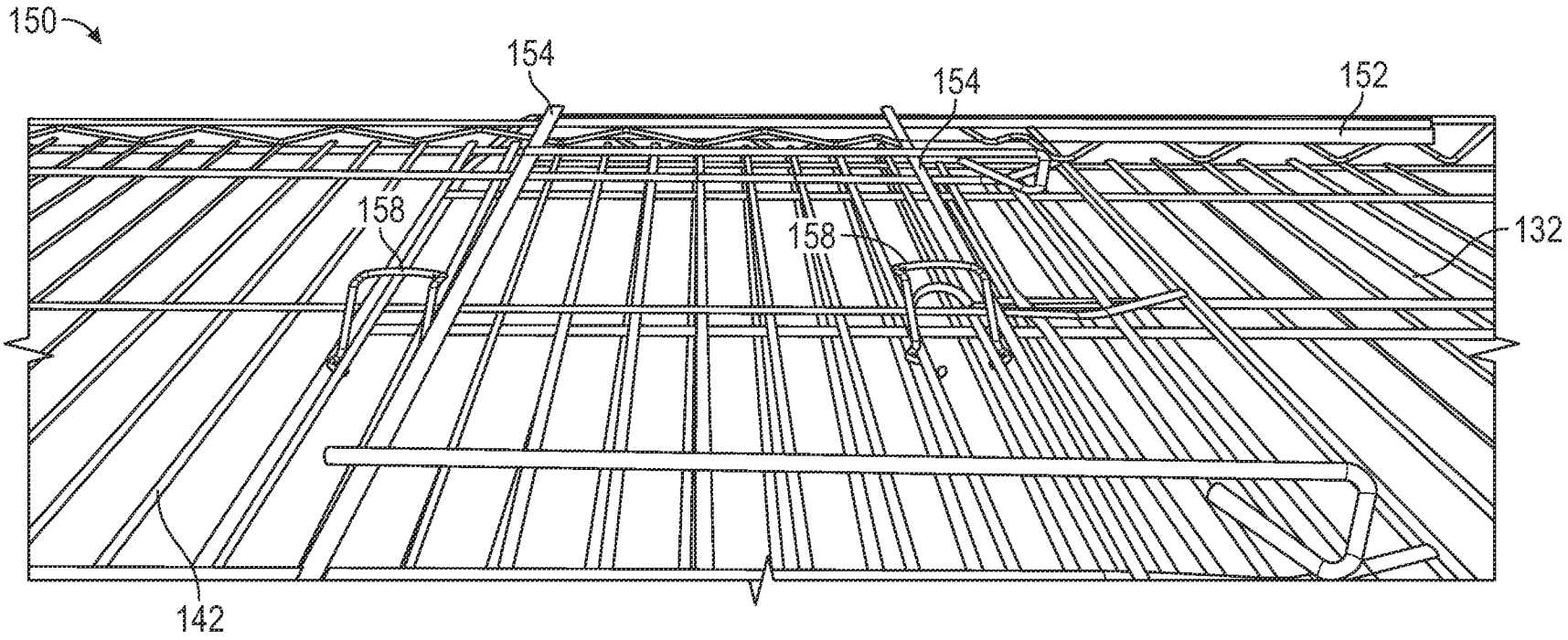
FIG. 8B illustrates a perspective view of locking clips configured to lock expandable shelf of FIG. 7.

FIGS. 7, 8A, and 8B show detailed views of internal mechanism 150. In aspects, stop 156 may include a straight portion and a hooked portion. The straight portion of stop 156 may be connected across reinforcement bars 154, as previously noted, while the hooked portion of stop 156 is configured to contact angled portion 148 of second half 142 when expandable shelf 130 is in the fully expanded position. To hold first half 132 and second half 142 in place relative to each other, one or more locking clips 158 may be used. Although expandable shelf 130 is shown in the fully expanded position, locking clips 158 may be used when expandable shelf 130 is in a partially expanded position as well (i.e., when stop 156 is not in contact with angled portion 148). Locking clips 158 are inserted onto both a portion of surface 134 of first half 132 and a portion of surface 144 of second half 142, holding first half 132 and second half 142 in place relative to each other. For example, when surfaces 134 and 144 include a number of metal wires, locking clip 158 may be inserted onto (e.g., latched onto) both a metal wire of surface 134 and a metal wire of surface 144, thereby locking first half 132 and second half 142 in place. In aspects, locking clip 158 may be a snap hook fabricated from wire and configured to snap onto both a metal wire of surface 134 and a metal wire of surface 144, as shown in FIG. 8B. Expandable shelf 130 may additionally include a breakaway divot (not shown) such that when expandable shelf 130 is expanded, the top sides of surfaces 134 and 144 of first half 132 and second half 142, respectively, are kept approximately level. The breakaway divot is configured to prevent items placed on expandable shelf 130 from falling over.

Figure 9:
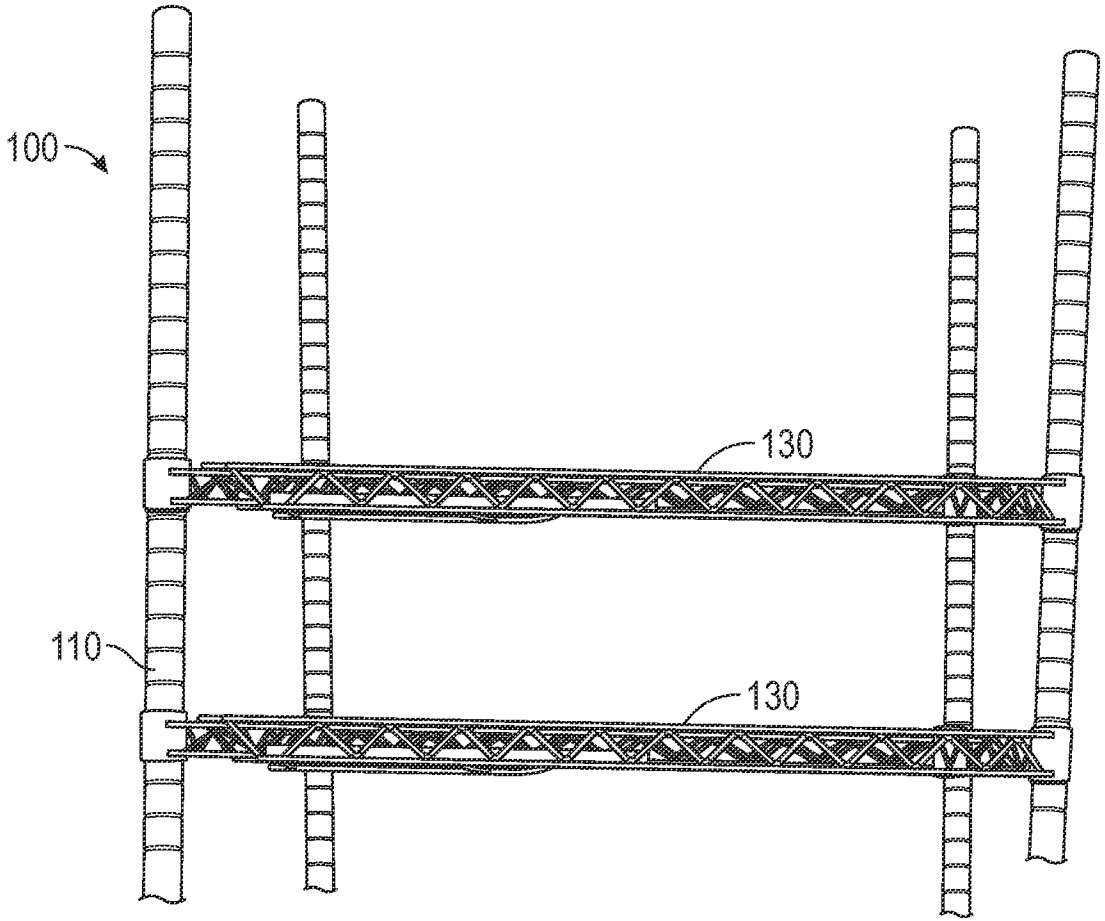
FIG. 9 illustrates a front view of the expandable stand-alone shelving assembly in a closed position, in accordance with the present disclosure.
Figure 10A:
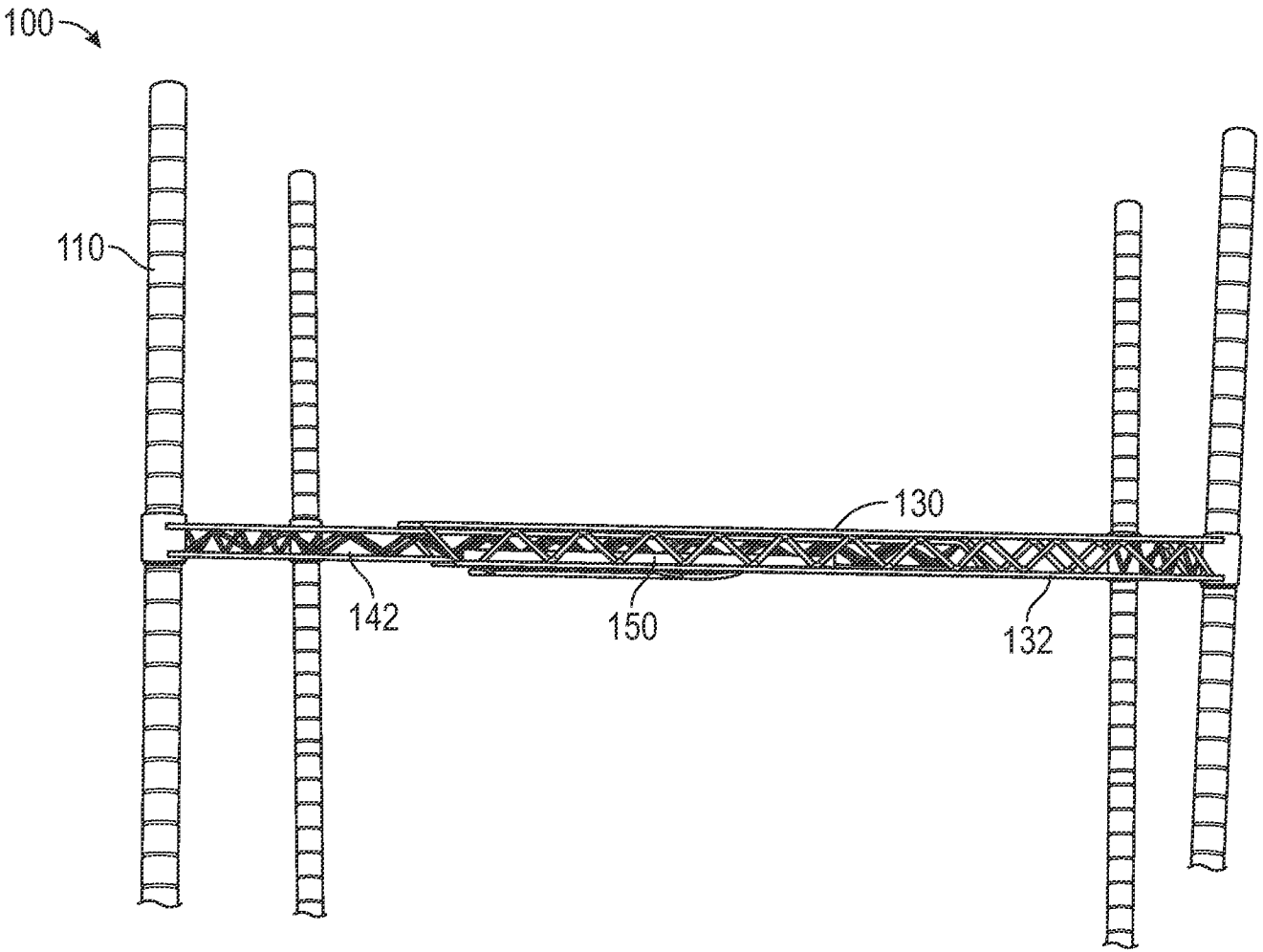
FIG. 10A illustrates a front view of the expandable stand-alone shelving assembly in a halfway expanded position, in accordance with the present disclosure.
Figure 10B:
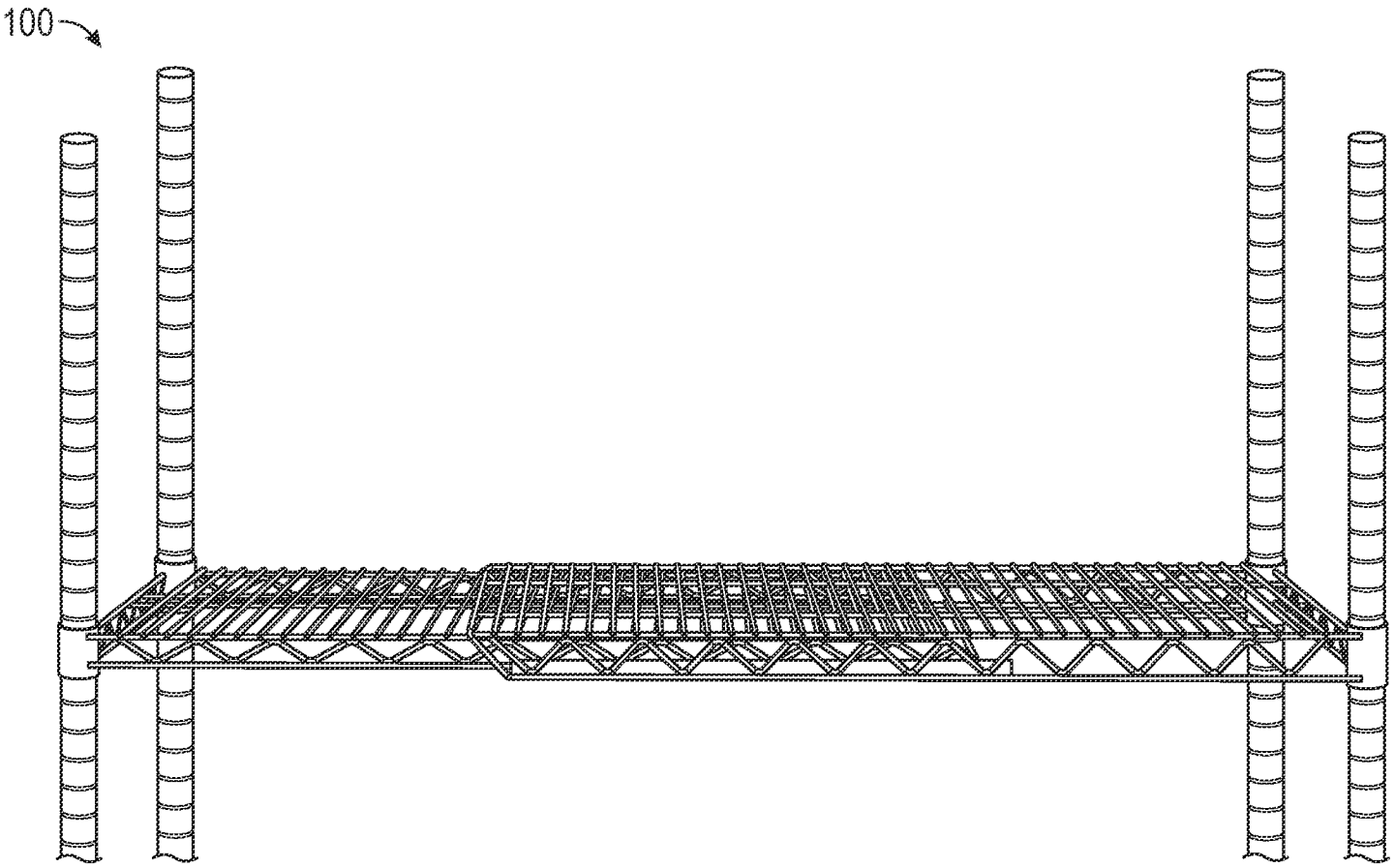
FIG. 10B illustrates a side perspective view of the expandable stand-alone shelving assembly in a halfway expanded position, in accordance with the present disclosure.
Figure 11A:
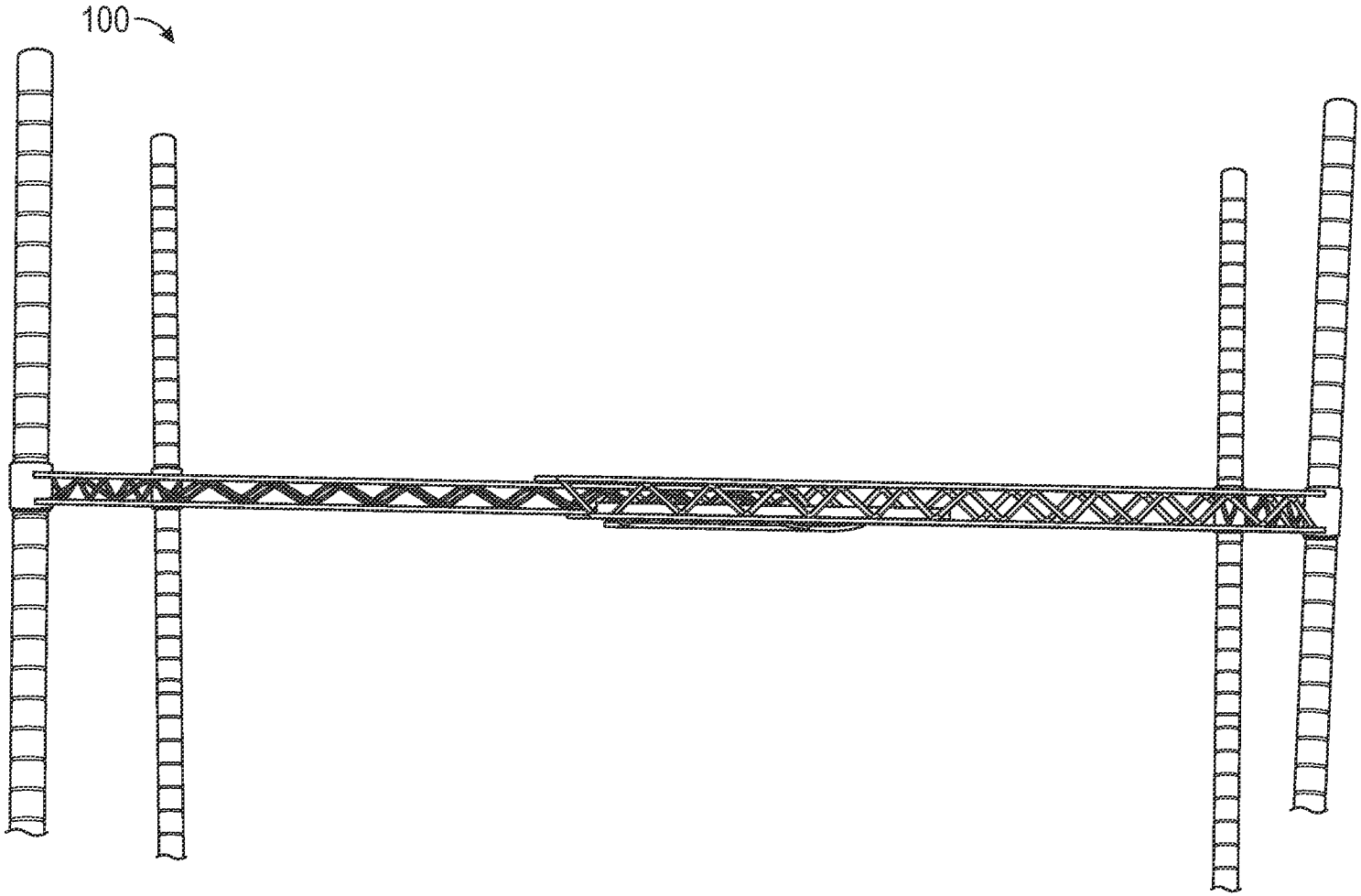
FIG. 11A illustrates a front view of the expandable stand-alone shelving assembly in a fully expanded position, in accordance with the present disclosure.
Figure 11B:
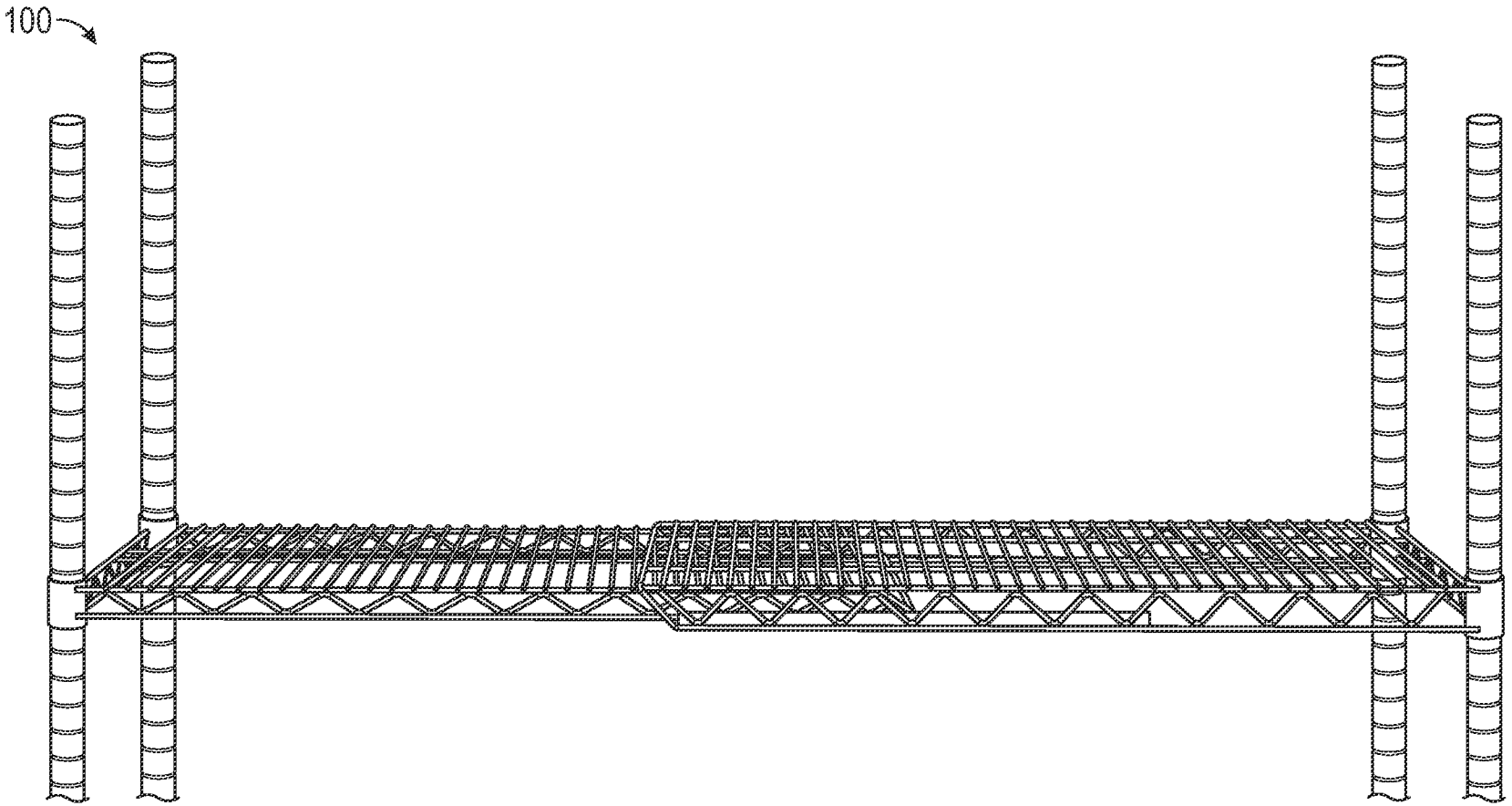
FIG. 11B illustrates a side perspective view of the expandable stand-alone shelving assembly in a fully expanded position, in accordance with the present disclosure.

With reference to FIG. 9, expandable stand-alone shelving assembly 100, in which the post assemblies 110 and two expandable shelves 130 are fully assembled, is shown in the closed position. Referring to FIGS. 10A and 10B, expandable stand-alone shelving assembly 100 is shown in a partially expanded, that is, approximately halfway expanded, position. Finally, in FIGS. 11A and 11B, expandable stand-alone shelving assembly 100 is shown in the fully expanded position.

Expandable stand-alone shelving assembly 100 is configured to take on a variety of configurations by including shelves which are height-adjustable, length-adjustable (i.e., expandable), and supplied in multiple widths. Depending upon the expanded length of expandable shelf 130, various amounts and weights of items may be supported on the top side of surface 134 and the top side of surface 144. In aspects, expandable stand-alone shelving assembly 100 may be capable of supporting about two-hundred-fifty pounds of evenly distributed weight per expandable shelf 130. In further aspects, for ease of transport and movement, expandable stand-alone shelving assembly 100 may include one or more wheels (not shown), which may be disposed on bottom end 112*b* of elongated posts 112. The variability of expandable stand-alone shelving assembly 100 provides an ideal use in hospitals and other institutions in which large quantities of goods are required to be stored and transported.

Certain aspects of the present disclosure may include some, all, or none of the above advantages and/or one or more other advantages readily apparent to those skilled in the art from the drawings, descriptions, and claims included herein. Moreover, while specific advantages have been enumerated above, the various aspects of the present disclosure may include all, some, or none of the enumerated advantages and/or other advantages not specifically enumerated above.

The aspects disclosed herein are examples of the disclosure and may be embodied in various forms. For instance, although certain aspects herein are described as separate aspects, each of the aspects herein may be combined with one or more of the other aspects herein.

Specific structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an aspect," "in aspects," "in various aspects," "in some aspects," or "in other aspects" may each refer to one or more of the same or different example Aspects provided in the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The aspects described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An expandable stand-alone shelving assembly comprising:

a post assembly including an elongated post and a sleeve, wherein the sleeve is configured to be coupled to the elongated post; and an expandable shelf including an aperture, a first half, a second half, and an internal mechanism, wherein:

when the post assembly is inserted into the aperture, the aperture is configured to at least partially accept the sleeve of the post assembly such that the expandable shelf is supported by the post assembly, the first half includes a surface, a top end, and a bottom end, the second half includes a surface and an angled portion extending downwards from the surface of the second half, the internal mechanism includes a reinforcement bar connecting the top end and the bottom end of the first half, and a stop disposed on the reinforcement bar nonparallel to the reinforcement bar, the second half is slidably received within the first half such that the second half is partially encapsulated by the first half and the internal mechanism, and when the first half and the second half are slid apart a predetermined distance, the stop of the internal mechanism is configured to engage with the angled portion of the second half to prevent the second half and first half from sliding apart beyond the predetermined distance.

2. The expandable stand-alone shelving assembly of claim 1, wherein the elongated post includes an indentation.

3. The expandable stand-alone shelving assembly of claim 2, wherein an interior surface of the sleeve includes a protrusion configured to be at least partially inserted into the indentation of the elongated post.

4. The expandable stand-alone shelving assembly of claim 1, wherein the sleeve includes a top end and a bottom end, and wherein the bottom end of the sleeve is wider than the top end of the sleeve.

5. The expandable stand-alone shelving assembly of claim 1, wherein the top end of the first half and the bottom end of the first half of the expandable shelf each further includes a slide.

6. The expandable stand-alone shelving assembly of claim 5, wherein the reinforcement bar is disposed on the slide of the top end sidewall and the slide of the bottom end sidewall of the first half of the expandable shelf.

7. The expandable stand-alone shelving assembly of claim 1, further comprising a locking clip configured to connect the first half and the second half of the expandable shelf such that the first half and the second half of the expandable shelf are held in place relative to each other.

8. The expandable stand-alone shelving assembly of claim 1, wherein the surface of the first half and the surface of the second half of the expandable shelf are formed from metal wire.

9. The expandable stand-alone shelving assembly of claim 8, further comprising a locking clip configured to latch onto a metal wire of the surface of the first half and a metal wire of the surface of the second half of the expandable shelf, wherein the locking clip is configured to hold the first half and the second half of the expandable shelf in place relative to each other.

10. The expandable stand-alone shelving assembly of claim 1, wherein the stop is perpendicular to the reinforcement bar.

11. The expandable stand-alone shelving assembly of claim 1, further comprising two or more expandable shelves.

12. An expandable stand-alone shelving assembly comprising:

a post assembly including an elongated post and a sleeve, wherein:

the elongated post includes a plurality of indentations spanning from a first end of the elongated post to a second end of the elongated post, and the sleeve is configured to be coupled to the elongated post via an indentation of the plurality of indentations; and an expandable shelf including an aperture, a first half, a second half, and an internal mechanism, wherein:

when the post assembly is inserted into the aperture, the aperture is configured to at least partially accept the sleeve of the post assembly such that the expandable shelf is supported by the post assembly, the first half includes a surface, a top end, and a bottom end, and a sidewall extending from each of the top end and the bottom end of the first half, the second half includes a surface and an angled portion extending downwards from the surface of the second half, the internal mechanism includes a slide disposed on each of the top end sidewall and the bottom end sidewall of the first half, a reinforcement bar connecting the top end sidewall and the bottom end sidewall of the first half, and a stop disposed on the reinforcement bar nonparallel to the reinforcement bar, the second half is slidably received within the first half such that the second half is partially encapsulated by the first half and the internal mechanism, and when the first half and the second half are slid apart a predetermined distance, the stop of the internal mechanism is configured to engage with the angled portion of the second half to prevent the second half and first half from sliding apart beyond the predetermined distance.

13. The expandable stand-alone shelving assembly of claim 12, wherein an interior surface of the sleeve includes a protrusion configured to be at least partially inserted into an indentation of the plurality of indentations of the elongated post.

14. The expandable stand-alone shelving assembly of claim 12, wherein the indentations of the elongated post are equally spaced apart.

15. The expandable stand-alone shelving assembly of claim 12, wherein the sleeve includes a first half and a second half, wherein the first half of the sleeve is configured to partially couple to an indentation of the plurality of indentations of the elongated post and the second half of the sleeve is configured to partially couple to the indentation of the plurality of indentations of the elongated post.

16. The expandable stand-alone shelving assembly of claim 12, wherein the stop is parallel to the slides.

17. The expandable stand-alone shelving assembly of claim 12, wherein the surface of the first half of the expandable shelf and the surface of the second half of the expandable shelf are formed from metal wire.

18. The expandable stand-alone shelving assembly of claim 17, further comprising a locking clip configured to latch onto a metal wire of the surface of the first half and a metal wire of the surface of the second half of the expandable shelf, wherein the locking clip is configured to hold the first half and the second half of the expandable shelf in place relative to each other.

19. An expandable stand-alone shelving assembly comprising:

a post assembly including an elongated post and a sleeve, wherein:

the elongated post includes a plurality of equally spaced annular indentations spanning from a first end of the elongated post to a second end of the elongated post, the sleeve includes a top end and a bottom end, wherein the bottom end of the sleeve is wider than the top end of the sleeve, the sleeve includes a first half and a second half configured to be coupled together, and an interior surface of the sleeve includes an annular protrusion therearound, wherein the annular protrusion is configured to at least partially insert into an annular indentation of the plurality of annular indentations of the elongated post;

an expandable shelf including an aperture, a first half, a second half, and an internal mechanism, wherein:

when the post assembly is inserted into the aperture, the aperture is configured to partially accept the sleeve of the post assembly such that the expandable shelf is supported by the post assembly, the first half includes a surface, a first end, a second end, a top end, a bottom end, a sidewall extending around the surface of the first half at the first end, the top end, and the bottom end of the first half, the second half includes a surface, a first end, a second end, a top end, a bottom end, a sidewall extending around the surface of the second half at the second end, the top end, and the bottom end of the second half, and an angled portion extending downwards from the surface of the second half at the first end of the second half, the internal mechanism includes a slide disposed on each of the top end sidewall and the bottom end sidewall of the first half, reinforcement bars connecting the slides, and a stop disposed across the reinforcement bars, the second half is slidably received within the first half such that the second half is partially encapsulated by the first half and the internal mechanism, and when the first half and the second half are slid apart a predetermined distance, the stop of the internal mechanism is configured to engage with the angled portion of the second half to prevent the second half and first half from sliding apart beyond the predetermined distance; and a locking clip configured to connect the first half and the second half of the expandable shelf such that the first half and the second half of the expandable shelf held in place relative to each other.

20. The expandable stand-alone shelving assembly of claim 19, wherein the surface of the first half of the expandable shelf and the surface of the second half of the expandable shelf are formed from metal wire, and wherein the locking clip is configured to latch onto a metal wire of the surface of the first half and a metal wire of the surface of the second half of the expandable shelf.

* * * * *